US008776290B2

(12) United States Patent
Wilkinson et al.

(10) Patent No.: US 8,776,290 B2
(45) Date of Patent: Jul. 15, 2014

(54) TURNING PLATFORM

(75) Inventors: Mike Wilkinson, Little Hampton (GB); Robert Footitt, Trowell (GB)

(73) Assignee: Genie Care, Arundel (GB)

( * ) Notice: Subject to any disclaimer, the term of this patent is extended or adjusted under 35 U.S.C. 154(b) by 470 days.

(21) Appl. No.: 12/451,487

(22) PCT Filed: May 13, 2008

(86) PCT No.: PCT/GB2008/001660

§ 371 (c)(1),
(2), (4) Date: Feb. 16, 2010

(87) PCT Pub. No.: WO2008/139191

PCT Pub. Date: Nov. 20, 2008

(65) Prior Publication Data

US 2010/0138998 A1 Jun. 10, 2010

(30) Foreign Application Priority Data

May 15, 2007 (GB) ..... 0709328.9
Aug. 21, 2007 (GB) ..... 0716309.0

(51) Int. Cl.
*A61G 7/015* (2006.01)

(52) U.S. Cl.
USPC ..... 5/615; 5/607; 5/609; 5/691; 5/722; 5/655.3; 5/657

(58) Field of Classification Search
USPC ..... 5/607–609, 613–615, 691, 722, 655.3, 5/655.5, 657, 659, 660
See application file for complete search history.

(56) References Cited

U.S. PATENT DOCUMENTS

| | | | | |
|---|---|---|---|---|
| 154,060 | A * | 8/1874 | Mahler | 5/610 |
| 3,717,885 | A * | 2/1973 | De Mare | 5/607 |
| 4,287,620 | A | 9/1981 | Zur | |
| 5,313,679 | A * | 5/1994 | Yamaguchi | 5/659 |
| 2005/0114998 | A1 * | 6/2005 | Leventhal et al. | 5/615 |
| 2005/0160530 | A1 * | 7/2005 | Taguchi et al. | 5/618 |
| 2005/0166328 | A1 * | 8/2005 | Ben-Levi | 5/715 |
| 2006/0117482 | A1 * | 6/2006 | Branson | 5/600 |
| 2008/0256715 | A1 * | 10/2008 | Jones | 5/659 |
| 2011/0047703 | A1 * | 3/2011 | Tarsaud et al. | 5/607 |
| 2011/0107520 | A1 * | 5/2011 | Neggers | 5/706 |

FOREIGN PATENT DOCUMENTS

| | | |
|---|---|---|
| EP | 1 486 191 | 12/2004 |
| EP | 1 669 049 | 6/2006 |

* cited by examiner

*Primary Examiner* — William Kelleher
(74) *Attorney, Agent, or Firm* — Levy & Grandinetti

(57) ABSTRACT

A turning platform having longitudinally extending side portions hinged to a central portion and hydraulic, or pneumatic, expansion means beneath each side portion operated by control means to raise and lower said side portions by rotating them about the hinges in a predetermined sequence.

20 Claims, 4 Drawing Sheets

Fig 5
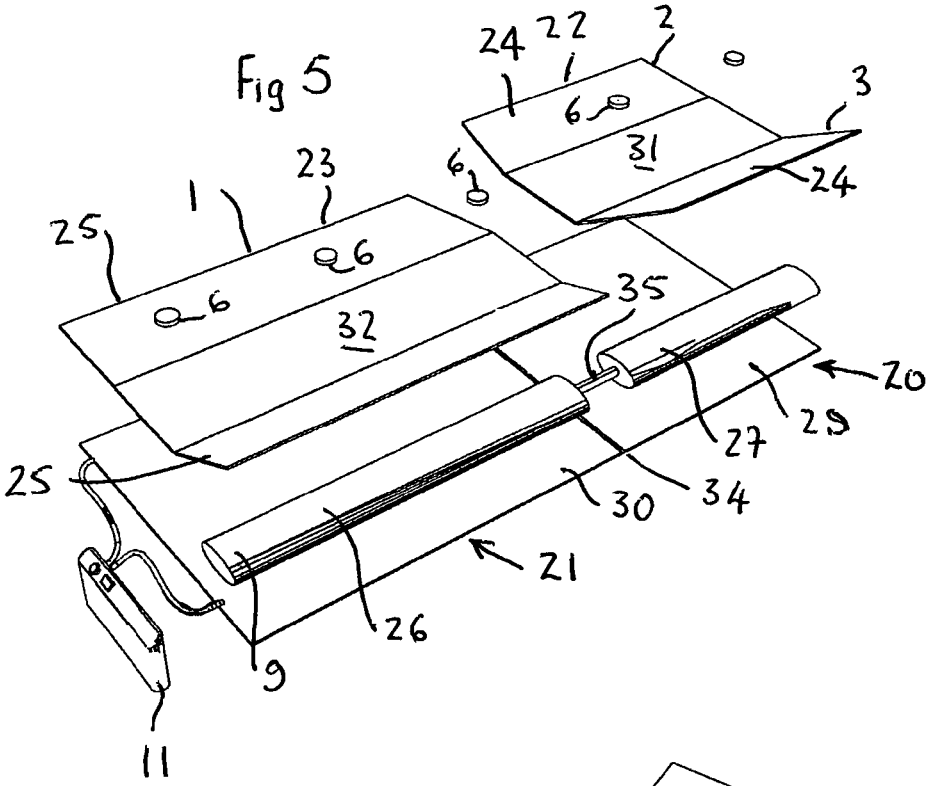
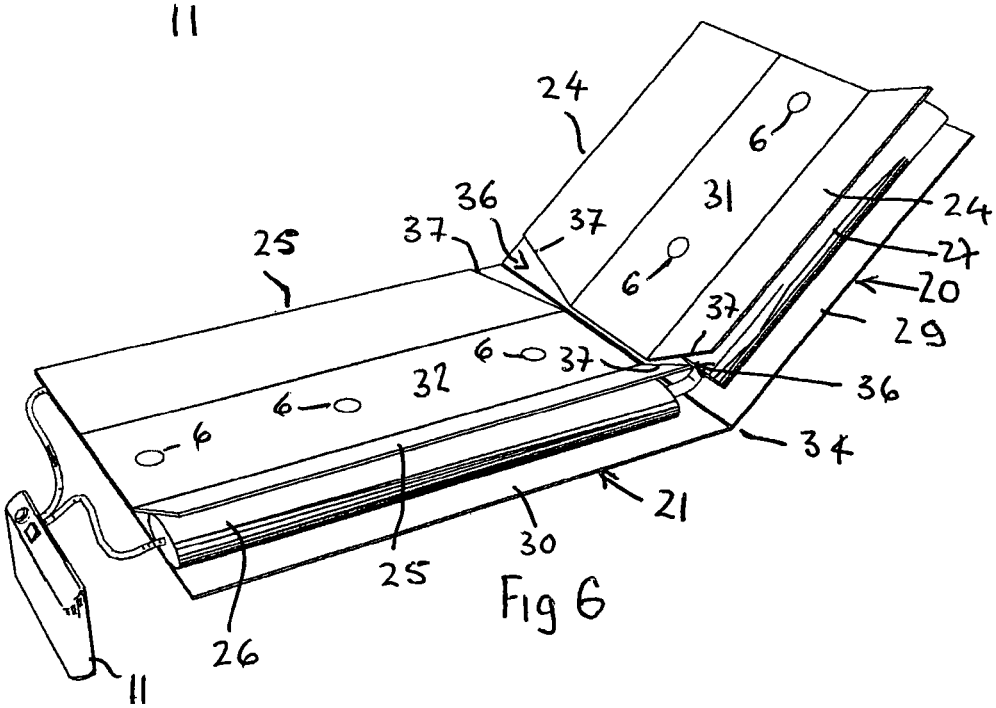
Fig 6

TURNING PLATFORM

The Applicants claim priority to International Application Number PCT/GB2008/001660, filed on May 13, 2008, which claims priority to Great Britain Application Number 0716309.0 filed on Aug. 21, 2007, and Great Britain Application Number 0709328.9 filed on May 15, 2007.

This invention relates to a turning platform which can be used in a lateral turning bed system.

Long term patients, lying in bed, tend to develop pressure sores and it is advisable to turn them onto one side, or the other, at intervals. The present invention relates to a turning platform which can be operated to turn patients in this way and which can operate at predetermined intervals without supervision from nursing staff.

According to the present invention a turning platform has longitudinally extending side portions which are hinged to a central portion and hydraulic, or pneumatic, expansion means beneath each side portion operated by control means to raise and lower said side portions by rotating them about the hinges in a predetermined sequence.

Thus, a patient lying on the central portion is raised and turned by one or other of the side portions in a predetermined sequence.

The turning platform is constructed so that it can be attached directly to any standard bed (using straps or a clamping system) and a mattress is then put over the top of the turning platform prior for use by the patient.

In a preferred construction said central portion is connected to a lower element between which and each side portion the expansion means is located.

Each of the expansion means can include an expansible bladder and the control means can be operated to deliver fluid or gas, depending upon the construction, beneath each side portion in a predetermined sequence.

The control means can be arranged to act in a timed sequence to raise one side portion gradually over a specified time period, lower said side portion, proceed through a dwell stage and then raise the other side portion gradually over a specified time period, and to then continue with the timed sequences until de-activated.

Thus, the raising and lowering of each side portion can extend over a time period of approximately ten minutes and the dwell stage can be between ten to twenty minutes or any other time sequence, as required.

Preferably the control means can be adjusted to vary the time periods.

If desired one end of the turning platform can be raised in relation to the remainder about a transverse hinge line normal to its length.

Thus the platform can be on a profiling bed, that is, a bed having a head which can be pivoted upwardly to place the patient's upper body in a more upright position.

With this arrangement each side of the side portions can be provided as two separate parts each of which has a separate expansion means beneath it, one of said parts being on the end which can be raised and the other being on the remainder.

Preferably the second expansion means beneath each side portion are connected to operate simultaneously although, if required separately.

The two separate parts of each side portion can be divided by a V-shaped gap formed by angled ends adjacent to separate parts.

The lower element in this construction can be provided with a transverse hinge at the transverse hinge line.

The invention also includes a turning platform as set forth above in combination with or attached to a supporting bed or bed frame.

The invention can be performed in various ways but one embodiment will now be described by way of example and with reference to the accompanying drawings in which:

FIG. 5 is an exploded isometric view of another construction of a turning platform according to the invention; and FIG. 6 is an isometric view of the construction shown in FIG. 5 assembled ready for use.

Figure 1:
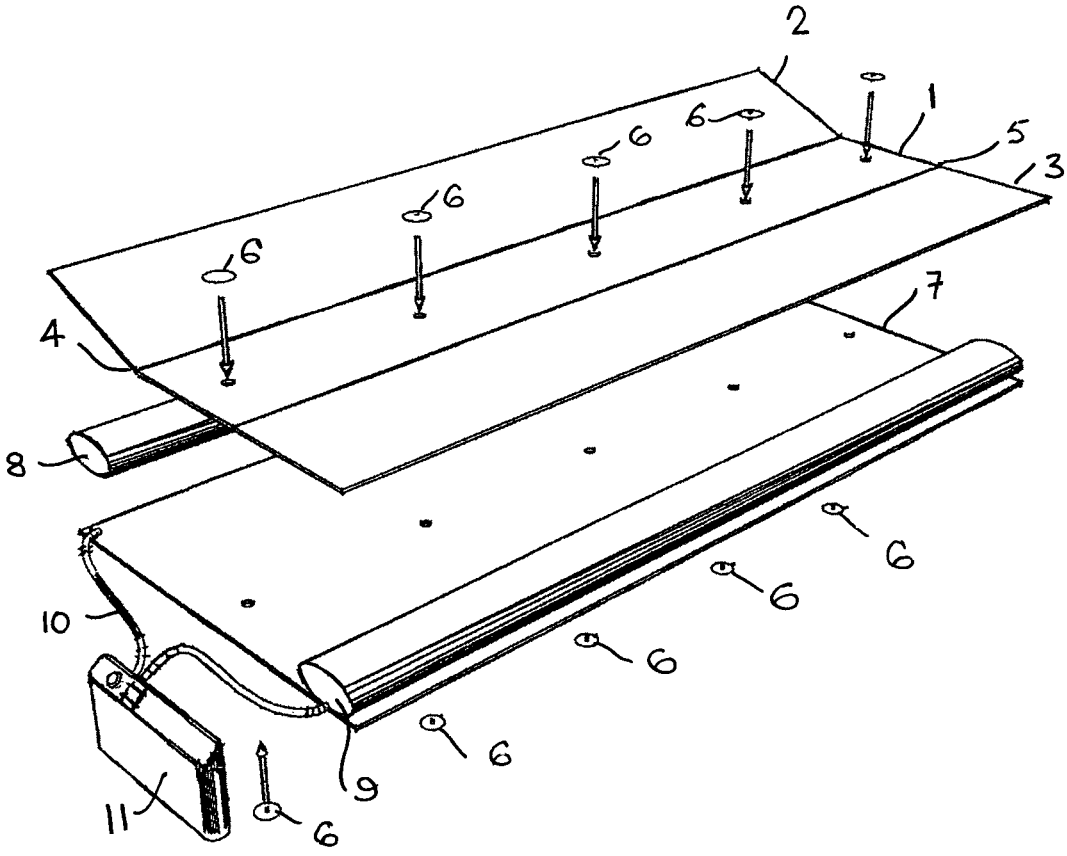
FIG. 1 is an exploded isometric view from above of a turning platform according to the present invention.

As shown in FIG. 1 a turning platform according to the invention comprises an upper element 1 which is made from a suitable rigid plastics material or metal or any other convenient material and has left and right longitudinally extending side portions 2 and 3, each being connected to the central portion by a living hinge 4 and 5 respectively. The central portion 1 is connected by plastic material rivets 6 to a lower element 7 made from similar rigid plastics material. Two longitudinally extending flexible bladders 8 and 9 are located beneath the side portions 2 and 3 and above the lower element 7. In this example described herein the expansion means bladders are pneumatically operated by air or any other preferred gas and are connected by pipes 10 to control means 11. In FIG. 1 the bladders 8 and 9 are shown in their expanded state.

Figure 2:
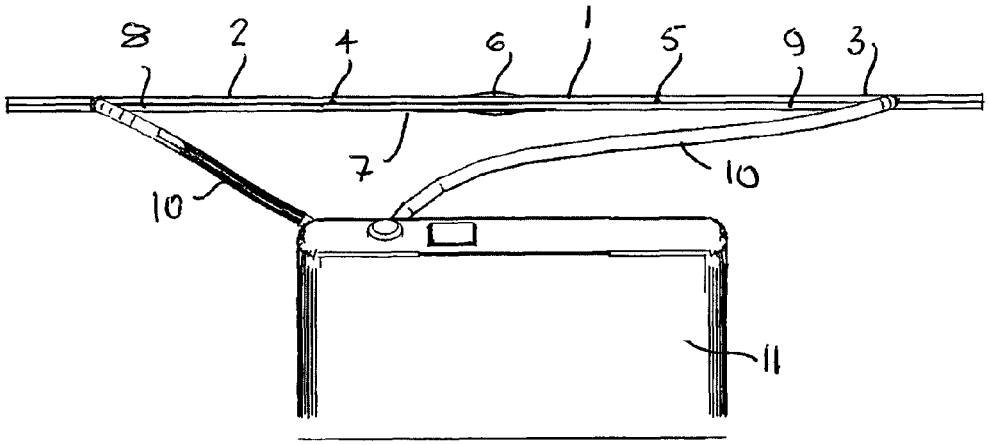
FIG. 2 is an end elevation of the construction shown in FIG. 1 when assembled ready for use.

As will be seen from FIG. 2 the bladders 8 and 9 are flattened when vented so that the upper surface of the central portion and side portions is substantially flat.

Figure 3:
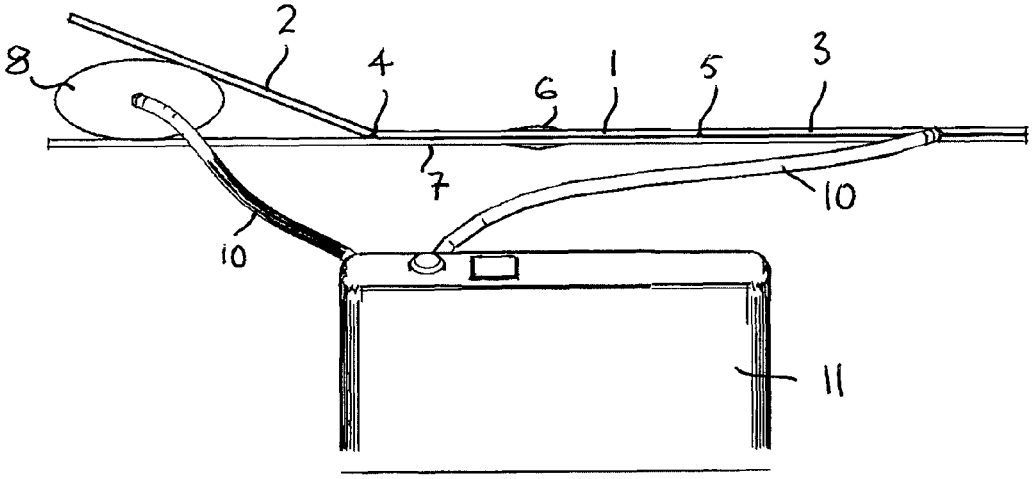
FIG. 3 is an end elevation of the construction shown in FIG. 2 in operation.

When the left hand bladder 8 is expanded, as shown in FIG. 3, the left hand side portion 2 is rotated about the hinge 4 connecting it to the central portion 1.

The right hand side portion 3 can be operated in a similar manner.

Figure 4:
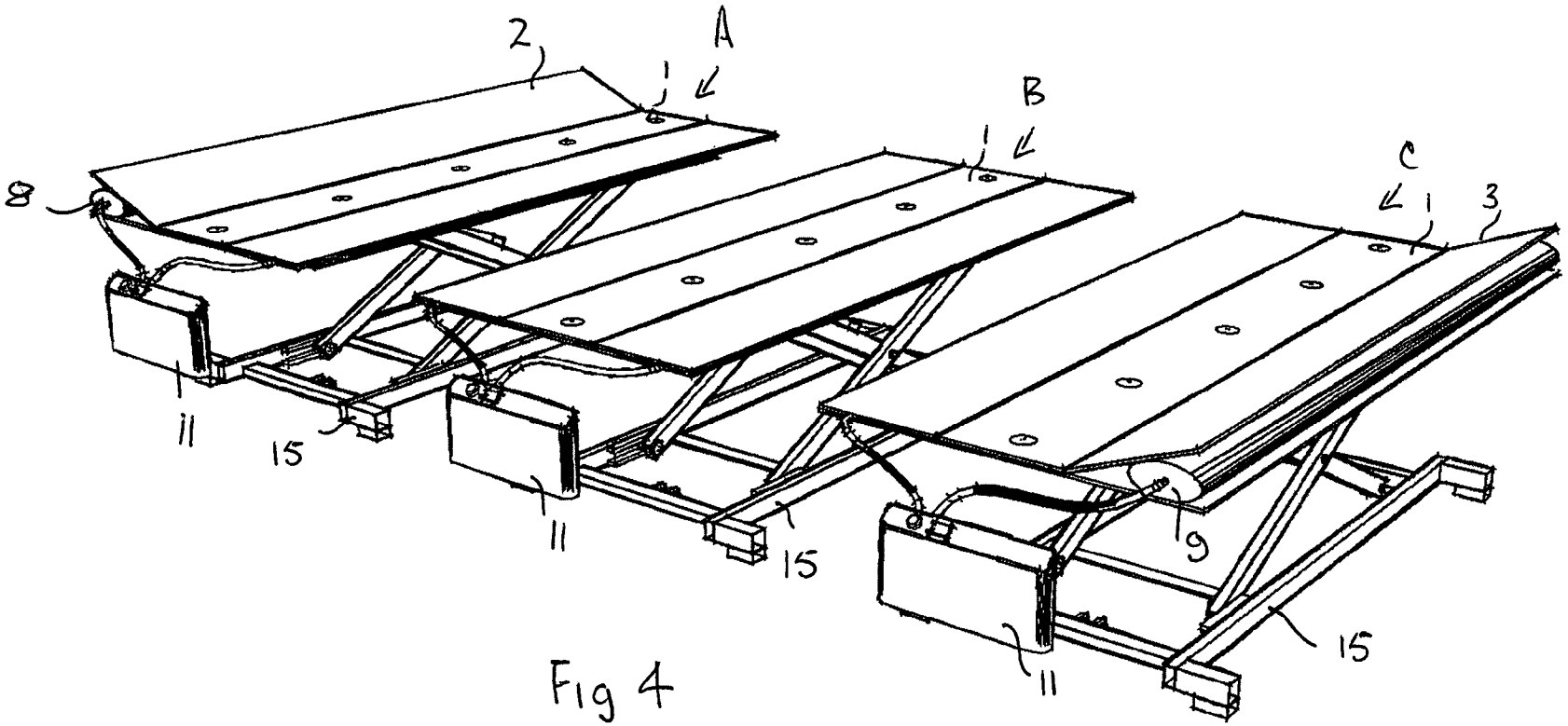
FIG. 4 is an isometric view from above of the construction shown in FIGS. 1, 2 and 3 in different operative positions.

FIG. 4 shows the turning platform according to the invention in combination with or attached to a standard bed frame, indicated by reference numeral 15. The attachment can be carried out in any suitable way, for example by using straps or a clamping system (not shown).

The control unit 11 can be constructed using conventional equipment so that it provides a timed sequence of gas supply to the bladders 8 and 9. The system is electrically operated and includes a pump or pumps for providing gas to the bladders as required. It also includes an adjustable timer.

The control means 11 can be adjusted to act in a timed sequence to raise and lower one side portion gradually over a specific time period, lower said side portion, proceed through a dwell stage and then raise the other side portion gradually over a specified time period, and to then continue with the timed sequence until de-activated.

FIG. 4 shows the timed sequence of events, indicated by the reference letters A, B and C.

When activated the control unit starts its timed sequence. To turn the patient the left hand bladder 8 is gradually inflated over a time period of approximately ten minutes. This lifts the left hand side portion 2 to the position shown at A. This will cause the mattress placed on top of the turning platform to lift on this side or have the effect of causing the patient to roll over onto the other half of the bed. After this time period the bladder 8 is vented so that the left hand side portion returns to its unactivated position and the bed presents a substantially flat upper surface as shown at B. The control system now commences its dwell stage of between ten to twenty minutes and after this the control system operates right hand bladder 9 to cause the right hand side portion 3 to rotate about its hinge 5. This raises this side of the bed and rolls the patient back onto the central portion 1 and left hand side portion 2. Once again, there will be a dwell period with the patient in this position and the cycle then recommences and continues until de-activated.

The apparatus can be operated and is intended to turn a patient between one and two times per hour or as infrequently as required. The control means 11 include an interface to allow the timing to be adjusted as required.

In the construction described above the bladders 8 and 9 are actuated pneumatically but in an alternative construction (not shown) the operation of the bladders 8 and 9 could be hydraulic.

The use of hydraulic or pneumatic expansion means allows for a simple and effective construction. It will be appreciate that in the construction shown only a single bladder 8 or 9 is employed on each side but, if desired, a number of bladders could be used to provide the necessary rotation of the side portions.

In an alternative construction (not shown) the bladders 8 and 9 can be replaced by one or more hydraulic or pneumatic rams which are located to act between the side portions and the lower element. The rams can comprise a cylinder and piston construction and would need to be located on the lower element 7 so they extend beneath it when the side portions are in their lowered positions. Alternatively, the connection between the central portion 1 and the lower element can include a spacer or spacers so that there is room for the ramps to lie between the side portions 2 and 3 and the lower element 7 when in their vented positions and with the upper surface of the platform being substantially flat.

FIGS. 5 and 6 show another construction of a turning platform which incorporates the invention. In FIGS. 5 and 6 the same reference numerals are used to indicate similar parts to those shown in FIGS. 1 to 4.

In this construction the turning platform is designed so that it can be used with a profiling bed, that is, a bed having a head which can be pivoted upwardly to place the patient's upper body in a more upright position. Beds of this type are well-known and are frequently used in hospitals and nursing homes.

In this construction one end of the turning platform indicated by reference numeral 20 can be raised in relation to the remainder of the platform indicated by reference numeral 21. The upper element 1 is made in two parts 22 and 23 as are longitudinal extending side portions 2 and 3 which are also each in separate parts 24, 25.

Separate expansion means 26 and 27 are provided for each separate side part 24 and 25. In FIGS. 5 and 6 the expansion means 26 and 27 are not shown on the left hand side of the construction. Two lower elements 29 and 30 are provided and are connected to the central portions 31, 32 by rivets 6 in a similar manner to that described with regard to the construction shown in FIGS. 1 to 4. Again the side portions 24 and 25 are hinged in a similar manner to the earlier construction.

The two lower elements 29 and 30 are hinged together at a transverse hinge line 34 and the expansion means 26 and 27 are connected by a flexible tube 35.

Control means 11 are again provided and method of operation is to be similar to that described with regard to the construction shown in FIGS. 1 to 4.

As will be seen from FIG. 6 the platform can be placed on a known type of profiling bed in a position with the end of the platform on which the upper body of the patient would be located in a raised angled position. This can be achieved due to the hinge 34.

In order to avoid the adjacent ends of the two separate side portion parts 24 and 25 engaging each other they are divided by a V-shaped gap 36 formed by angled ends 37 of the two separate parts 24, 25.

In the construction described above the hinge is provided by hinge line 34 on the lower element and the centre portions 31, 32 are not connected but any other convenient form of hinging with or without connection of the various part can be used.

In the construction shown in the drawings the flexible bladders 26 and 27 on each side are operated simultaneously but if it is more convenient a suitable valving system could be incorporated so that they could be operated separately.

The timing sequences and other operating arrangements can be the same as that described with regard to FIGS. 1 to 4.

The invention claimed is:

1. A turning platform for supporting and turning a patient, said platform comprising a flat horizontal lower platform element of rigid material and an upper platform element having a longitudinally extending central portion directly fixed to a central portion of said lower platform element and longitudinally extending side portions hingedly attached to respective opposite longitudinal edges of said central portion and hydraulic, or pneumatic, expansion means on said lower platform element beneath each said side portion, operated by control means to raise and lower said side portions in turn by rotating them about the hinges in a predetermined sequence, wherein said side portions are both positioned to extend below and support a patient lying on said platform and are configured in turn to raise and turn said patient relative to said central portion in respective opposite directions when raised by said expansion means relative to said central portion.

2. A turning platform as claimed in claim 1 in which each of said expansion means includes an expansible bladder.

3. A turning platform as claimed in claim 1 in which the control means can be operated to deliver fluid to expansion means beneath each side portion in a predetermined sequence.

4. A turning platform as claimed in claim 1 in which the control means can be operated to deliver gas to said expansion means beneath each said side portion in a predetermined sequence.

5. A turning platform as claimed in claim 1 in which the control means acts in a timed sequence to raise one side portion gradually over a specified time period, lower said side portion, proceed through a dwell stage and then raise the other side portion gradually over a specified time period, and to then continue with the timed sequences cut off.

6. A turning platform as claimed in claim 5 in which the raising and lowering of each side portion extends over a time period of approximately ten minutes and the dwell stage over ten or twenty minutes or any other time sequence, as required.

7. A turning platform as claimed in claim 5 in which the control means can be adjusted to vary the time periods.

8. A turning platform as claimed in claim 1 including means for attachment to a supporting bed or bed frame.

9. A turning platform as claimed in claim 8 in which one end can be raised in relation to the remainder about a transverse hinge line normal to its length.

10. A turning platform as claimed in claim 9 in which each of the side portions is provided as two separate parts each of which has a separate expansion means beneath it, one of said parts being on the end which can be raised and the other being on the remainder.

11. A turning platform as claimed in claim 10 in which the separate expansion means beneath each of the side portions are connected to operate simultaneously.

12. A turning platform as claimed in claim 10 in which the two separate parts of each side portion are divided by a V-shaped gap formed by the angled ends of the adjacent two separate parts.

13. A turning platform as claimed in claim 9 in which the lower element is provided with a transverse hinge at the transverse hinge line.

14. A turning platform as claimed in claim 1 in combination with or attached to a supporting bed or bed frame.

15. A turning platform as claimed in claim 1 in which each of said expansion means includes an expansible bladder.

16. A turning platform as claimed in claim 1 in which the control means can be operated to deliver fluid to expansion means beneath each side portion in a predetermined sequence.

17. A turning platform as claimed in claim 15 in which the control means can be operated to deliver gas to said expansion means beneath each side portion in a predetermined sequence.

18. A turning platform as claimed in claim 1 including means for attachment to a supporting bed or bed frame.

19. A turning platform as claimed in claim 1 in which one end can be raised in relation to the remainder about a transverse hinge line normal to its length.

20. A turning platform for supporting and turning a patient, said platform comprising a flat horizontal lower element of rigid material, a central horizontal longitudinally extending central portion directly fixed to an upper side of said lower element, longitudinally extending side portions hingedly attached to respective opposite longitudinal edges of said central portion and hydraulically or pneumatically expansible bladders means between said lower element and each said side portion, said bladders being operated by control means to raise and lower said side portions in turn by rotating them about respective hinged connections to said central portion in a pre-determined sequence, wherein said side portions are both positioned to extend below and support a patient lying on said platform and are configured in turn to raise and turn said patient in respective opposite directions relative to said central portion when said side portions are raised by expansion of said bladders.

* * * * *